United States Patent [19]

Brewer et al.

[11] 4,142,584

[45] Mar. 6, 1979

[54] TERMINATION MEANS FOR A PLURALITY OF RISER PIPES AT A FLOATING PLATFORM

[75] Inventors: John H. Brewer, Irvine; Peter G. Harwood, Mission Viejo, both of Calif.

[73] Assignee: Compagnie Francaise des Petroles, Paris, France

[21] Appl. No.: 817,159

[22] Filed: Jul. 20, 1977

[51] Int. Cl.[2] ..... E21B 33/035

[52] U.S. Cl. ..... 166/359; 166/364; 166/365; 175/7

[58] Field of Search ..... 166/0.5, 0.6, 359, 364, 166/365; 175/7, 321; 61/99; 114/0.5 D

[56] References Cited

U.S. PATENT DOCUMENTS 3,324,943 6/1967 Price ..... 175/7 X

*Primary Examiner*—Ernest R. Purser

*Attorney, Agent, or Firm*—Poms, Smith, Lande & Glenny

[57] ABSTRACT

A termination means for a plurality of riser pipes at a floating platform including a termination member for supporting said plurality of riser pipes, said termination member being supported and suspended by constant tension means on said platform. The plurality of riser pipes include a central riser pipe and satellite riser pipes arranged around said central riser pipe. Each of the satellite riser pipes extend through the termination member and are supported from said termination member by fluid pressure actuated tension compensator means which serve to tension each of the riser pipes. The termination means is adapted to both rigid and flexible riser pipes.

11 Claims, 6 Drawing Figures

Fig. 1.
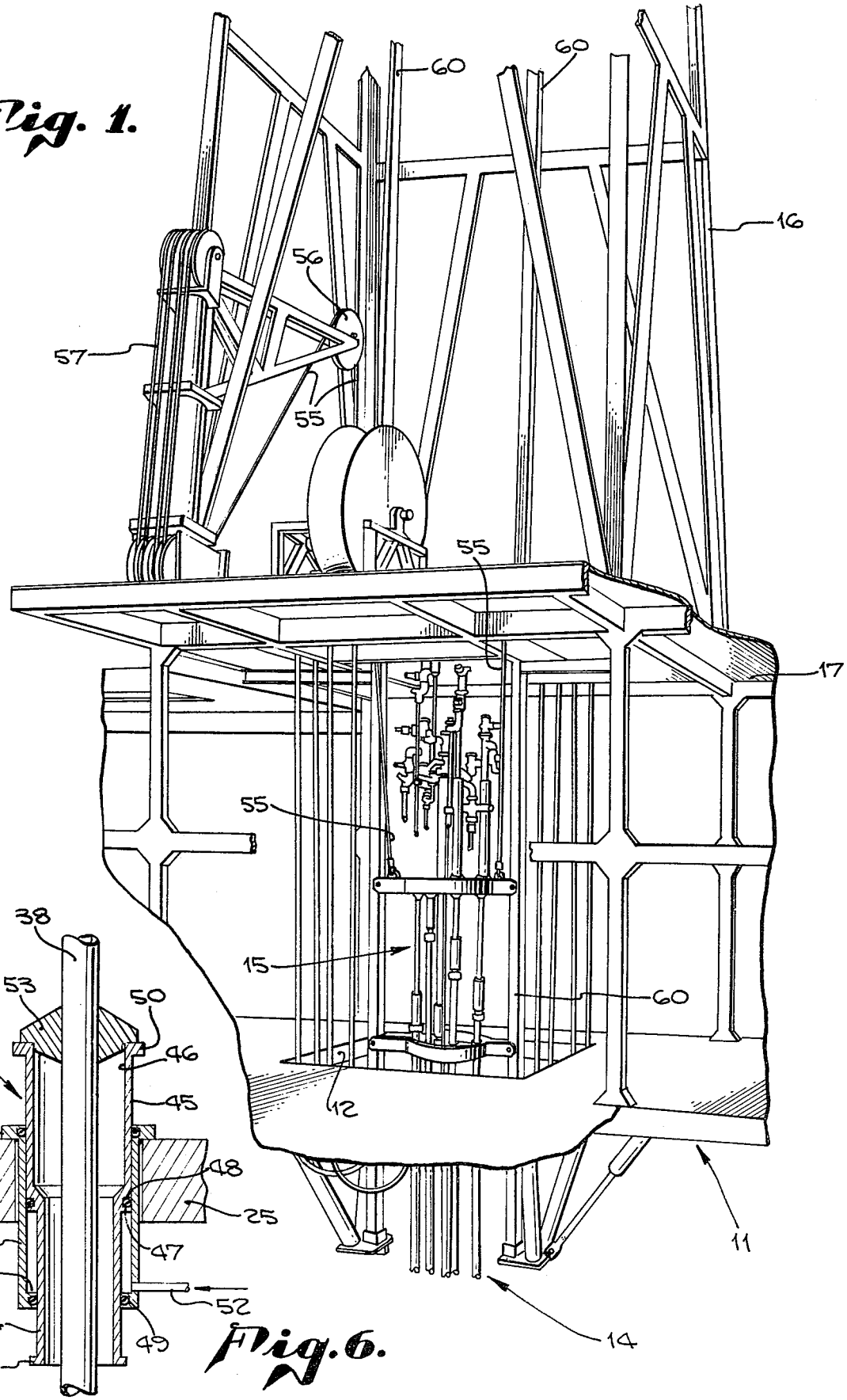
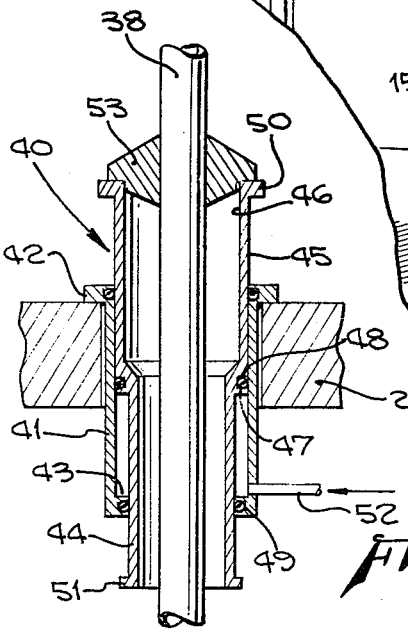
Fig. 6.

69
68
72
73
55
71
74
66
66
74a
73
72
74
IV
VI
IV
75
40
40
74a
45
67
65
67
75
32
54
42
45
39
-25-
39
61
61
41
52
32
52
41
VI
38
37
31
38
60
30
60
III
62
29
37
62
III
28
61
36
28
26
36
61
80
35
27
80

TERMINATION MEANS FOR A PLURALITY OF RISER PIPES AT A FLOATING PLATFORM

BACKGROUND OF THE INVENTION

Marine production risers may be associated with a floating vessel or floating platform where ocean wave conditions cause the platform to heave and relative movement occurs between the upper end portion of the riser system and the platform.

Various systems have been employed for connecting the upper end of a production riser pipe to a platform. Individual risers; that is, a single riser pipe extending from the seabed to the floating platform, have often been provided with slip joints just below the platform to allow such relative movement of the platform and the upper end portion of the riser pipe. In some systems, a ball joint is provided at the platform to accommodate relative angular movement of the riser pipe with respect to the platform. The upper end portion of such prior riser systems were connected to constant tension lines for support of the riser pipe.

Some prior proposed marine production riser systems have included a plurality of riser pipes terminated at a floating platform. In such instances, each of the plurality of riser pipes were supported and tensioned individually. As a result, the space above the termination of such a plurality of riser pipes was cluttered with many cables and various equipment. It was difficult to work in such space, particularly when work was performed on perhaps only one of the riser pipes.

In addition, such prior proposed termination of the plurality of riser pipes at the platform employed means for tensioning each riser pipe individually. It will be understood that each riser pipe may be carrying a fluid having different characteristics with respect to internal pressure, weight, density, and temperature. As a result of the fluid conducted by each riser pipe, the tension imposed upon such a riser pipe may vary. In prior proposed systems, each riser pipe was tensioned individually and individual support of a plurality of such pipes presented difficulties because of constantly varying conditions.

SUMMARY OF INVENTION

This invention relates to a novel construction and arrangement of a termination means for the upper portion of a marine production riser system which includes a plurality of riser pipes. The invention particularly relates to a termination means for a marine riser system as described and claimed in U.S. Pat. No. 4,098,333 issued July 4, 1978 owned by a common assignee. The concept of the termination means of this invention is readily adaptable to and useful with flexible riser pipes and with rigid riser pipes, such as steel pipes.

The present invention contemplates a termination member cooperably receiving two or more riser pipes, the termination member being supported by a selected number of constant tension cables. In case of flexible riser pipes, the termination member is guided along a selected path axially of the riser system and lateral movement thereof relative to such axis is restricted by the guiding means whereas in the case of rigid riser pipes, the termination member will be suspended. The upper portion of each riser pipe is supported from the termination member by a tension compensator means. The tension compensator means operates under pressure fluid to support each riser from the termination member, and the several tension compensating members are operable in connection with a fluid pressure means to provide selected tension to each riser pipe. Each riser pipe is permitted to move relative to each other riser pipe, and while individually supported and tensioned, the riser pipes may be supported in equal or other preselected tension.

The invention further contemplates in one embodiment (flexible riser) a termination means having two termination members or plates whereby one plate (e.g., the upper plate) provides the support function described above and whereby the other (lower) plate provides for support and quick release and connection of the riser pipes at the termination means during assembly and retrievel of the riser pipes. In another embodiment (rigid risers) the termination means contemplates a suspended plate having means cooperable with the plate and the rigid riser pipes for tensioning thereof. The method of support of the termination plate provides overhead access to one or more riser pipes while the other riser pipes may remain connected.

The primary object of the present invention therefore is to provide a novel termination means for a marine riser production pipe system at a floating platform.

An object of the invention is to provide a termination means at a floating platform wherein tension forces are distributed to two or more risers while permitting relative axial movement of any or all of the risers.

Another object of the present invention is to provide a guide means for a termination means for a marine riser system as described above.

Another object of the invention is to provide a novel support means for a plurality of marine riser pipes wherein a main support member is provided for the plurality of pipes and each of said pipes is subjected to support forces depending upon the individual loads imposed upon such riser pipe.

A further object of the invention is to provide a termination means for a plurality of marine riser pipes wherein quick connect and disconnect means are provided for each pipe and each may be connected and disconnected at the termination means without interfering with the operation of the other riser pipes.

A further object of the invention is to disclose and provide a termination means for a riser pipe system wherein the termination means is supported by constant tension means in a manner which requires fewer or a reduction in such tension lines.

A still further object of the invention is to provide a termination means for a plurality of marine riser pipes at a floating platform wherein the termination means provides rapid disconnection of said riser pipes.

Various other objects and advantages of the present invention will be readily apparent from the following description of an exemplary embodiment of this invention shown in the drawings.

IN THE DRAWINGS

FIG. 1 is an enlarged fragmentary view of a floating platform deck having an opening to receive the upper end of a marine riser system embodying this invention, the riser system having flexible riser pipes.

FIG. 6 is a sectional view of tension means for each satellite riser pipe and adapted for flexible, and in some instances rigid riser pipes.

Figure 2:
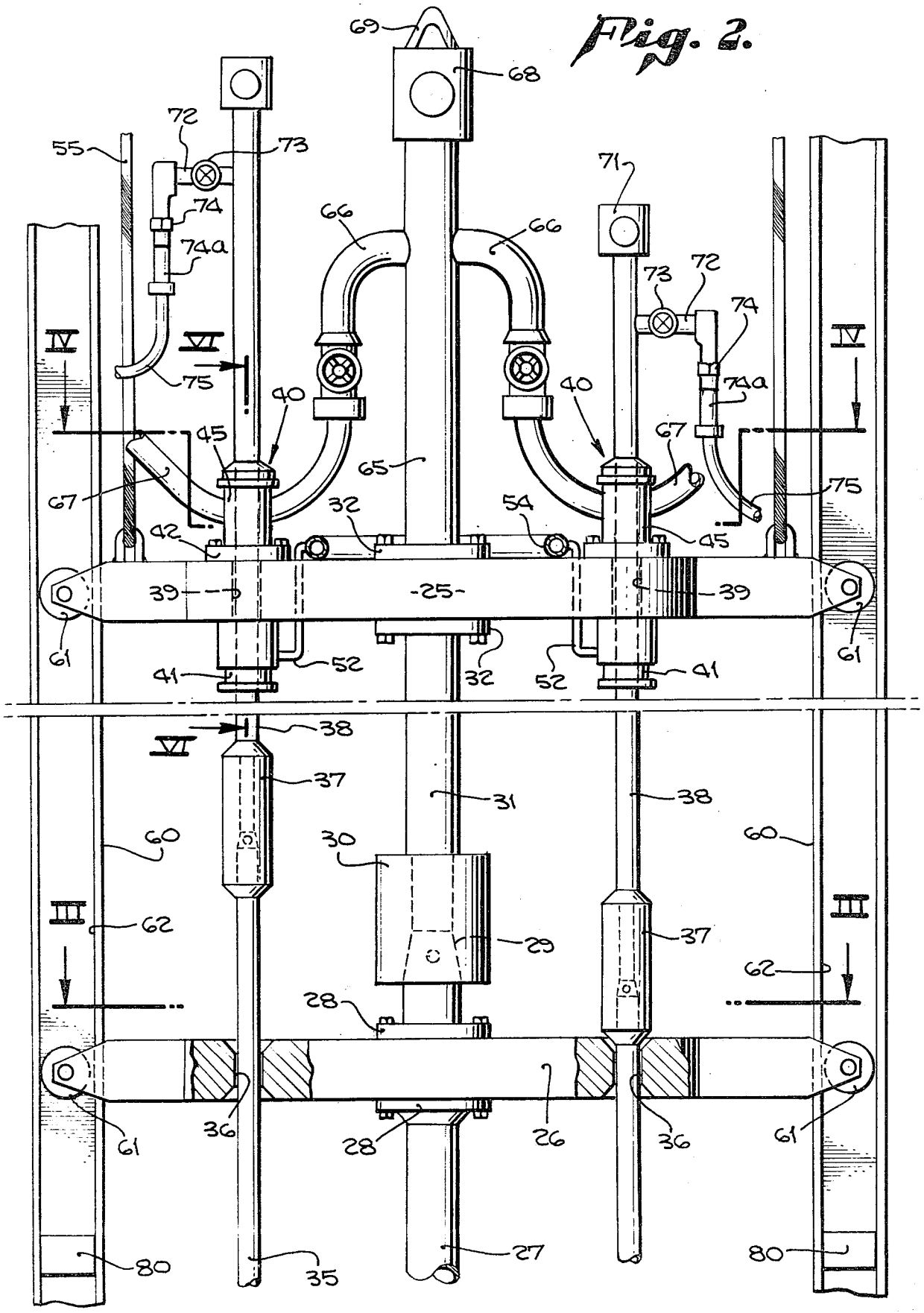
FIG. 2 is an enlarged fragmentary view of a termination means embodying this invention used in FIG. 1.
Figure 3:
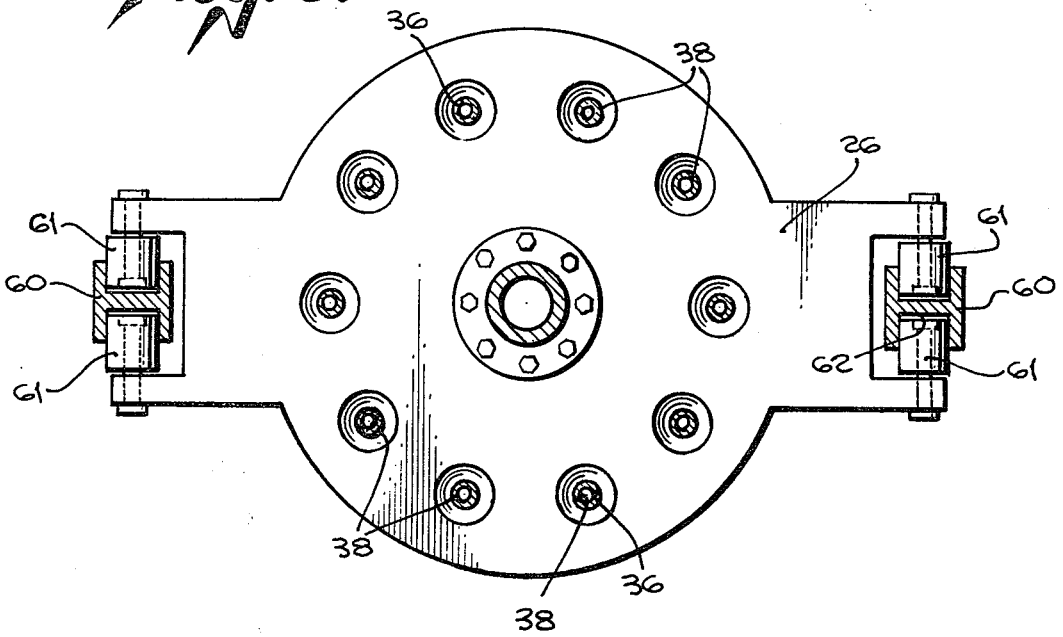
FIG. 3 is a transverse sectional view taken in the plane indicated by III—III of FIG. 2.
Figure 4:
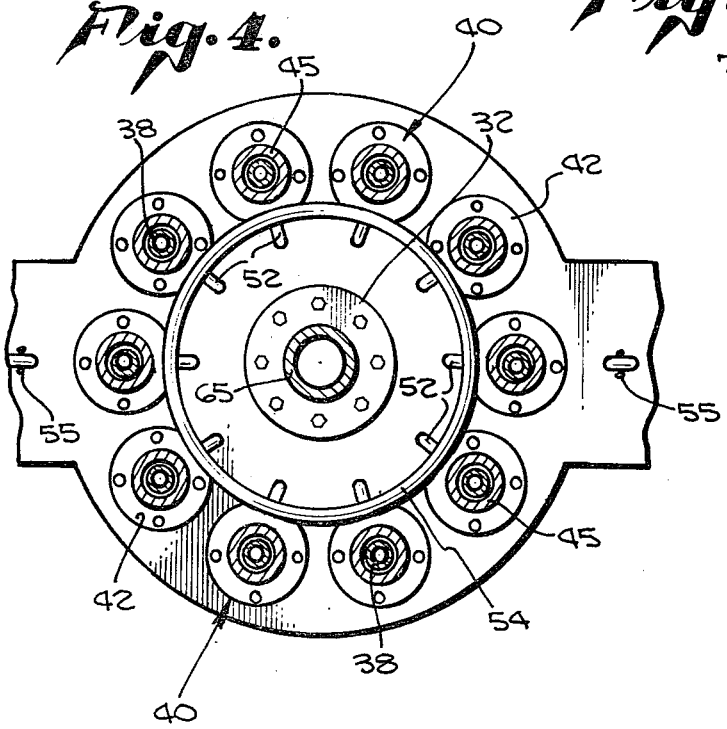
FIG. 4 is a fragmentary sectional view taken in the plane indicated by line IV—IV of FIG. 2.

In the drawings, FIG. 1 fragmentarily shows a floating platform 11 having a moon pool or opening 12 adapted to receive the upper end portion of a production riser system having flexible riser pipes and generally indicated at 14. The upper end portion of riser system 14 is supported from a termination means 15 embodying this invention. The upper end of the riser system 14 may be connected with production equipment, not shown, for processing hydrocarbon fluids transported from a subsea well to the lower end of the marine riser system 14 and brought to the platform deck for treatment before returning the processed hydrocarbon fluid through the marine riser system to a flowline on the sea floor for conducting the processed fluid to suitable storage or other facility. The process equipment is not shown. Floating platform 11 may be of any suitable type for production operations and includes semi-submersible platform, floating vessels, or other types of vessels which are at the ocean surface and which are subjected to ocean wave, wind and current conditions. The floating platform may be moored to the sea floor, or may be equipped with self-positioning means to maintain its location over the point at the seabed where the marine riser extends vertically to the platform.

Platform 11 is provided with necessary well equipment, such as a derrick 16, suitable deck structure 17 for supporting pipe, reels of cable, storage winches, tensioning winches, and various other equipment necessary for a marine production riser system operation.

Equipment on the platform which is used in the present system for terminating the marine riser system at the platform includes suitable constant tension means provided with tension cable, a fluid pressure source for hydraulic fluid circuits used in the operation of the termination means, such pressure fluid source including suitable hydraulic pumps and accumulators and other valve equipment later described.

Figure 5:
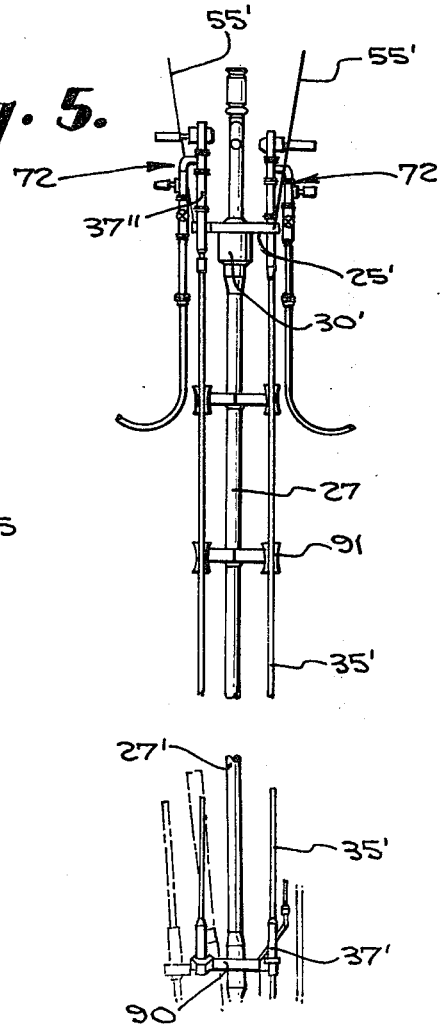
FIG. 5 is a fragmentary elevational view of the termination means of this invention adapted for rigid steel riser pipes.

The marine riser system 14 may include any riser system having two or more riser pipes for conducting hydrocarbon fluids, the first example shown in FIGS. 1 through 4 inclusive relating to flexible riser pipes, and the second example shown in FIG. 5 relating to rigid steel riser pipes. The present invention is described with respect to a marine production riser system, described and claimed in U.S. Pat. No. 4,098,333 issued July 4, 1978. The riser system (both flexible and rigid) in said application includes an upper riser portion, a lower riser portion connected to a base means on the sea floor to which sea floor flowlines are attached, and a submerged buoyant structure providing suitable tension to the lower riser portion and providing, at its submerged level, an interconnection between upper and lower riser portions at a suitable depth beneath the surface of the ocean which is less affected or not affected at all by ocean waves, ocean currents and wind surface conditions. The said riser system includes a plurality of satellite riser pipes arranged around a central riser pipe. The central riser pipe and the satellite riser pipes of the upper riser portion are supported by the termination means of this invention. The said marine riser system was designed to permit quick release of the upper riser portion from the buoyant structure and the lower riser portion so that in the event of an approaching storm or bad ocean weather conditions, it would be possible to disconnect the upper riser portion from the buoyant structure and leave the buoyant structure and lower riser portion intact and in freestanding, upright position generally unaffected by the storm conditions. The present invention relating to the termination means of the upper riser portion of such a marine riser system is primarily concerned with the connection of the upper end portion of the upper riser portion to the platform and the production treatment equipment thereon.

As best seen in FIG. 2, the termination means embodying this invention comprises an upper termination plate or member 25 and a lower termination plate or member 26, said members 25, 26 being of generally the same configuration. Central riser 27 is suitably connected to the bottom plate 26 by flange means 28 and is provided with a mandrel 29 which is mated with a quick release connector 30 carried at one end of a spacer pipe 31. The upper end of spacer pipe 31 is connected by suitable flange means 32 to upper termination member 25. Spacer pipe 31 extends above termination member 25 and is equipped as later described.

Each of the satellite riser pipes 35, which conduct production fluid to the floating platform, may pass through circularly arranged openings 36 in lower termination member 26, and above member 26 satellite pipes 35 are connected to quick release connectors 37. Each satellite riser pipe 35 mates with a connector 37 which is affixed to the lower end of the extension pipe 38 which extends through an aligned opening 39 in upper termination member 25. Extension pipe 38 may project through a tension compensating means 40 for connection with a valve tree thereabove as later described.

Each tension compensating means includes a cylinder 41 having a top flange 42 seated on and secured to upper plate 25. The lower end of cylinder 41 has an inturned flange 43 defining an opening to slidably receive a lower sleeve portion 44 of a sleeve piston 45. Piston 45 has an enlarged upper sleeve portion 46 defining a shoulder 47 which defines a fluid pressure chamber with flange 43, lower sleeve portion 44, and cylinder 41, the chamber being sealed by suitable resilient seals 48 and 49. The upper end of sleeve portion 46 has an outwardly directed flange 50 which limits downward movement of piston sleeve 45 upon engagement with flange 42. A ring 51 threaded on the lower end of sleeve portion 44 limits upward movement of sleeve 45 by engagement with flange 43. Fluid under pressure enters the chamber at fitting 52.

Each satellite riser extension pipe 38 is provided with a suitable support collar 53 adapted to land and seat on the top end of a piston sleeve 45 of its associated tension compensating means 40. Each of the fluid chambers of the tension compensating means 40 is connected to a hydraulic manifold line 54 which is connected to a fluid pressure accumulator (not shown) for supplying fluid under pressure to each of the fluid chambers below piston sleeves 45. Tension in each satellite riser pipe may vary.

Means for supporting upper termination member 25, together with the central riser 27 fixedly attached thereto and with the tension compensating means 40 secured thereto and supporting under fluid pressure the upper portions of the riser pipes 35, includes a selected number of cable lines 55 suitably attached to the periphery of termination member 25. In this example, cables 55 extend upwardly from the upper termination plate over a sheave 56 and to a constant tension means 57. The constant tension means 57 support through a selected number of constant tension cable lines the loads carried by the upper termination member 25.

Means for guiding the termination means 15 in a path in the direction of the axis of the derrick 16 may comprise a pair of rails 60 supported on the structure of the floating platform on opposite sides of the moon pool opening 12 and extending below said opening for a suitable distance and extending upwardly into the derrick area to permit suitable vertical travel of the termination means and equipment associated therewith during assembly and disassembly. Opposite ends of termination members 25 and 26 carry suitable guide wheels 61 for reception within the channels 62 provided by the rail means 60 which may be of H section. The termination means 15 is thus provided generally vertical reciprocal movement along the rails and any lateral movement relative to the axis of the derrick is restricted and restrained by said rails.

The upper ends of the central and satellite riser pipes 27 and 35, respectively, are connected to processing equipment on the platform. Spacer pipe 31 is provided with a strand pipe 65 having downturned guides 66 for reception and connection to jumper hoses 67, which receive the discharge of processed fluid from the processing equipment on the platform. The top of stand pipe 31 may include a swab valve 68 and a suitable bail 69 for attachment of a lift or support cable not shown.

Each satellite extension pipe 38 may also include a swab valve 71 at its top end. Below swab valve 71 and above the tension compensator means 40, a laterally extending pipe 72 may include a gate valve 73, a choke means 74, and a flow erosion resistant pipe **74*a* which is connected to a satellite jumper hose 75** which conducts unprocessed production fluid to the process equipment.

It is important to note that the upper termination plate 25 supports central riser pipe 27 and satellite riser pipes 35 through tension compensating means 40. Instead of a cable line connected to each of said riser pipes as found in the prior art, termination plate 25 serves to support all of said riser pipes by a relatively few constant tension lines 55 suitable distributed around the periphery of the termination plate. Plate 25 fixedly supports and carries the central riser pipe and, through the tension compensator means 40, yieldably and controllable supports the setellite riser pipes to automatically compensate for length changes in the satellite riser pipes due to load changes to which the satellite pipes are subjected.

It will also be noted that the termination plate 25 and the guide means therefor serve as spiders or frames as to keep the upper ends of the pipes in desired orientation with the riser system therebelow and facilitates working on one or more of said riser pipes without interferring with the operation of other riser pipes.

In the marine riser system described in said copending application Ser. No. 771,799, a stab assembly may be disconnected from its associated lower riser pipe portion. When this occurs, the constant tension lines 55 may be used to readily lift the termination plates 25 and 26 to a selected height, depending upon the capacity of the derrick rig to facilitate transport of the upper riser portion or service and maintenance thereof, if required.

It is also important to note that the upper termination plate 25 and the arrangement of extension pipe 38 with quick release connectors 37 thereon provide means for quick release from satellite riser pipes 35 by actuating connectors 37. In the event such quick release is made, the satellite riser pipes may be readily supported by landing surfaces 78 on lower termination plate 26. In this example, lower termination plate 26 is still supported by the constant tension cables 55 through the upper termination plate 25 and the central riser spacer pipe 31, which rigidly interconnects the top and bottom plates 25 and 26.

In some instances, it may be desirable to remove upper termination plate 25 to one side of the upper ends of the riser pipes, in which event lower termination plate 26 is supported by stop blocks 80 fixed to guide rails 60 by suitable means at a selected location to limit downward travel of plate 26. In such instances, it will be apparent that the weight of the depending central riser pipe 27 and satellite riser pipes 35 will be carried by the termination plate 26. Plate 25 and equipment thereabove may be readily worked upon.

It will thus be readily apparent that the loads carried by the termination plate means are readily supported and distributed in a uniform manner to the constant tension cable lines 55 and that changes in length and tension of satellite riser pipes are readily compensated for by the tension compensating means 40, which are separately and independently operably connected to each satellite riser pipe.

In the above described embodiment of the invention, examples of central and satellite riser pipes of flexible hose type have been described and shown in cooperable association with the termination plate means. Termination plate means of this invention may also be utilized with central and satellite riser pipes made of rigid steel pipe. In an embodiment utilizing steel pipe for both central and satellite riser pipes, FIG. 5, the lower termination plate 26 and guide rails 60 may be omitted and support of the riser pipes is accomplished through the connection of the constant tension cable lines 55 to a transverse termination plate 25'. Satellite steel pipes are supported from a support plate carried by the central riser plate.

In further detail, termination plate 25' is supported by cables 55' of constant tension means, as in the prior embodiment. Termination plate 25' carries a connector means 30' to which is rigidly connected the central riser pipe 27'. Riser pipe 27' is rigidly connected to a support plate 90 which as described in U.S. Pat. No. 4,098,333 may be associated with a stab assembly located above a buoyant structure at about 300 feet of water depth. Support plate 90 carries satellite connector 37' and supports the weight of such satellite connectors 37' and satellite riser pipes 35' connected thereto. The upper ends of satellite riser pipes 35' extend through openings in termination plate 25' and include quick release connector means 37'' to which may be associated the valve and choke tree, generally indicated at 72', as described in the prior embodiment.

It will be apparent that the satellite riser pipes 35' are constrained against lateral movement by guide funnel assemblies 91 located at spaced intervals along the length of the central and satellite riser pipes 27' and 35'. Change in length of satellite riser pipes 35' is accommodated by relative movement of riser pipes 35' through openings provided for the satellite pipes in the termination member 25'.

It will thus be understood that the constant tension cable lines 55', which are connected to termination plate 25', carry the loads imposed on plate 25' by the central riser pipe 27' having support plate 90 which supports the satellite pipes 35' of the upper riser portion.

Various modifications and changes may be made in the termination means for a marine riser as described above which come within the spirit of this invention and all such changes and modifications coming within the scope of the appended claims are embraced thereby.

We claim:

1. A termination means for a marine production riser system at a floating platform having a constant tension means and a pressure fluid source, the riser system including a central riser pipe and a plurality of satellite riser pipes, comprising:

means for supporting said central riser pipe including a plate transverse to said central riser pipe and having openings for passage of said central and saellite riser pipes, said plate being connected to and suspended by said constant tension means on said platform; and a fluid pressure actuated tension compensator means carried by said plate for each satellite riser pipe for tensioning thereof.

2. A termination means as stated in claim 1 including:

guide means on said platform for said plate for movement thereof in the longitudinal direction of the riser system while restraining lateral movement thereof.

3. A termination means as stated in claim 1 wherein said supporting means includes a second plate below said first mentioned plate and having openings aligned with openings on said first plate for passage therethrough of said central and satellite riser pipes;

said central riser pipe being fixedly connected to said first and second plates.

4. A termination means as stated in claim 3 wherein said central riser pipe is provided with a quick release connector means at said second plate.

5. A termination means as stated in claim 3 wherein said satellite riser pipes are provided with quick release connector means positionable between said first and second plates for relative movement with respect thereto during tensioning of said satellite riser pipes.

6. A termination means as stated in claim 5 wherein said second plate has landing support surfaces for said quick release connector means on each of said satellite riser pipes for support of said satellite riser pipes during assembly and disassembly of said satellite riser pipes with said riser system.

7. A termination means as stated in claim 1 wherein each satellite riser pipe has an upper end extending above said tension compensator means and movable relative thereto;

and valve tree means carried by said upper end of said satellite riser pipe.

8. In a termination means for a marine production riser system at a floating platform; the combination of:

a termination member;

means connecting said termination member to said platform under constant tension;

at least two riser pipes having upper end portions extending through and above said termination member;

and support means at said termination member for at least one of said riser pipes; said termination member providing relative movement between said two riser pipes;

and means for selective tensioning of one of said pipes during production operations.

9. In a termination means for a marine riser system at a floating platform; the combination of:

a termination member;

means connecting said termination member to said platform under constant tension;

at least two riser pipes having upper end portions extending above said termination member;

support means at said termination member for at least one of said riser pipes and providing relative movement between said two riser pipes for permitting selective tensioning of said pipes;

and fluid pressure manifold means connected with said support means at said one of said two riser pipes for controlling tension in said one of said pipes.

10. In a termination means for a marine production riser system at a floating platform; the combination of:

a termination member transversely disposed with respect to the upper end of the marine riser system;

constant tension means on said floating platform connected to and supporting said termination member;

a plurality of production riser pipes extending through and above said transversely disposed termination member;

and means supporting said riser pipes from said termination member, said supporting means including means for securing one of said riser pipes to said termination member, and means for adjusting to changes in stress in said other production riser pipes.

11. A termination for a marine production riser system at a floating platform having constant tension means and a pressure fluid source, the riser system including a central riser pipe and a plurality of satellite riser pipes, comprising:

means for supporting said central riser pipe and said satellite riser pipes including a plate transverse to upper end portion of said riser pipes and having openings for reception of said central and satellite riser pipes, said plate being connected to and suspended by said constant tension means on said platform;

said central riser pipe being fixed to said plate;

means connected to said central riser pipe in downward spaced relation to said plate for supporting the weight of said satellite riser pipes;

said satellite riser pipes being independently movable in their respective openings relative to said plate during production;

and means for adjusting to changes in stress due to pressure and temperature of production fluid passing through said satellite riser pipes.

* * * * *